United States Patent [19]

Yarbrough

[11] 4,063,443

[45] Dec. 20, 1977

[54] ROD GRIPPING TOOL FOR APPLYING FASTENERS

[75] Inventor: Garrett Yarbrough, Buffalo Grove, Ill.

[73] Assignee: H. K. Porter Company, Inc., Pittsburgh, Pa.

[21] Appl. No.: 739,235

[22] Filed: Nov. 5, 1976

[51] Int. Cl.[2] ..... B21J 15/34

[52] U.S. Cl. ..... 72/391

[58] Field of Search ..... 72/391, 114; 29/243.53

[56] References Cited

U.S. PATENT DOCUMENTS

| | | | |
|---|---|---|---|
| 2,753,072 | 7/1956 | Mitchell | 72/391 |
| 3,197,987 | 8/1965 | Martin | 72/114 |
| 3,423,986 | 1/1969 | Young | 72/391 |
| 3,504,519 | 4/1970 | Hornung | 72/391 |
| 3,574,915 | 4/1971 | Jeal | 72/391 |
| 3,774,437 | 11/1973 | Young | 72/391 |
| 3,861,014 | 1/1975 | Summerlin | 72/114 |

*Primary Examiner*—C.W. Lanham
*Assistant Examiner*—Gene P. Crosby
*Attorney, Agent, or Firm*—Ladas, Parry, Von Gehr, Goldsmith & Deschamps

[57] ABSTRACT

A tool for releasably gripping a rod comprising: a structure supporting a rod clamping assembly which is movable relative to the structure; a release to cooperate with the clamping assembly to release a said rod gripped by the clamping assembly; and means for producing the relative movement wherein the means for producing the relative movement includes a motion converter to convert rotary motion of a first member into linear motion on a second member and vice versa; a clutch connected to transmit rotary motion to the first member; means for selectively engaging and disengaging the clutch; and a spring connected to bias the second member in opposition to the linear motion produced by the rotary motion; the second member being connected to transmit the linear motion to the clamping assembly when said clutch is engaged; the clutch disengaging means disengaging the clutch when the relative motion has produced a predetermined travel of the clamping assembly and the spring being connected to return the second member and the clamping assembly to its original position upon disengagement of the clutch.

8 Claims, 11 Drawing Figures

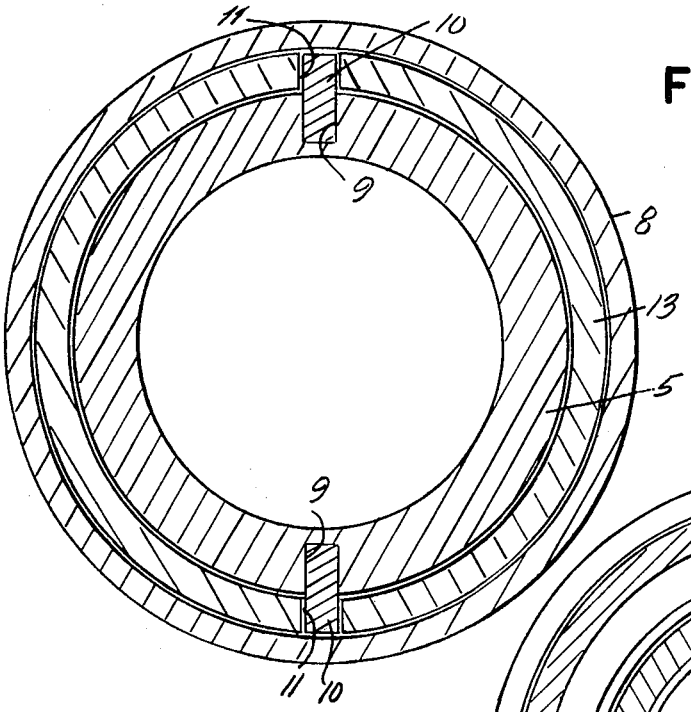
FIG. 6
FIG. 7
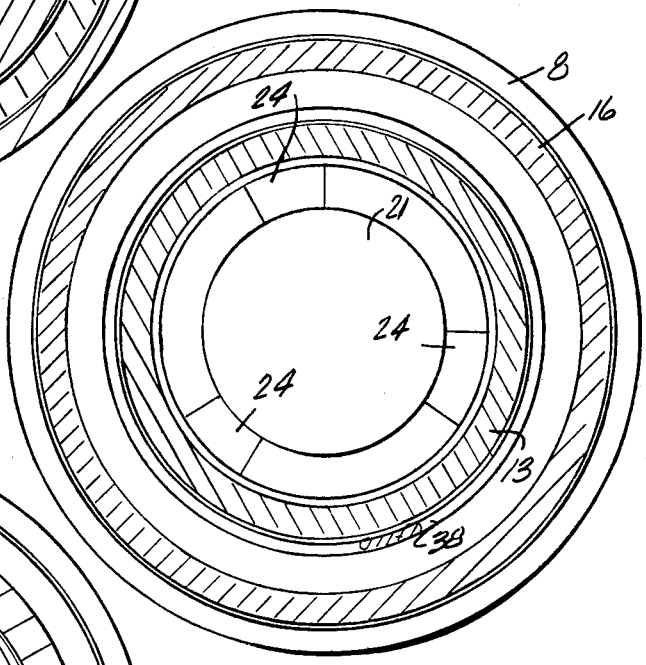
FIG. 8
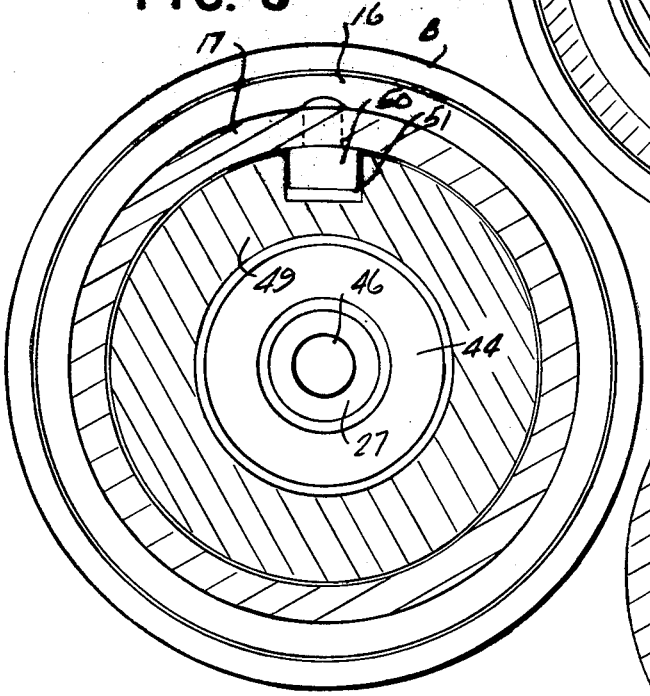
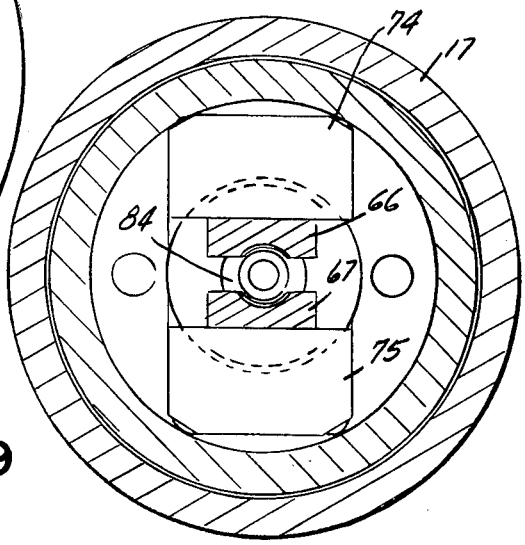
FIG. 9

ROD GRIPPING TOOL FOR APPLYING FASTENERS

This invention relates to a tool for applying fasteners, and particularly though not exclusively, to a tool for applying "blind rivets."

It is a primary object of the present invention to provide a tool of a readily portable nature which is capable of semi-automatic operation to apply fastners, such as "blind rivets," in a reliable and economical manner rendering the tool suitable for use in, for example, mass or batch production and the construction industry.

In connection with the inventive concept of this application attention is drawn to U.S. Pat. Nos. 3,872,570 and 3,958,318 both of which are owned by the Assignee of the present invention.

According to the invention there is provided a tool for releasably gripping a rod comprising: a support structure; a rod clamping assembly connected to said structure and movable relative to said structure; a release means connected to said structure and adapted to cooperate with said clamping assembly, when said clamping assembly and said structure are at one end of said relative movement, to release a said rod gripped by said clamping assembly; and means for producing said relative movement; wherein, upon operation of said means to produce said relative motion, away from said one end, a said rod, when gripped by said clamping assembly, is moved longitudinally relative to said structure; wherein the means for producing said relative movement comprises: a motion converter having first and second members supported by said structure and adapted to convert rotary motion of said first member into linear motion on said second member and vice versa; a clutch supported by said structure, having a driving member and a driven member connected to transmit rotary motion to said first member; means for selectively engaging said clutch; means to disengage said clutch; and biasing means connected to bias said second member in opposition to the linear motion produced by said rotary motion; and wherein said second member is connected to transmit said linear motion to said clamping assembly to produce said relative motion, away from said one end in opposition to the bias of said biasing means, when said clutch is engaged by said selective engaging means to transmit a rotary input motion to said first member; said clutch disengaging means cooperates with said clutch to engage said clutch when said relative motion has produced a predetermined travel of said clamping assembly away from said one end; said biasing means being connected to return said second member and said clamping assembly to said one end of said relative motion upon disengagement of said clutch.

It will be appreciated that the rod referred to in the above summary of the invention is, in the case of a "blind rivet," the mandrel which is broken from the "blind rivet" as this rivet is fastened.

A fastner applying tool according to the present invention will now be particularly described, by way of example, with reference to the accompanying drawings, in which:

FIG. 6 is a cross-section along section line A—A of FIG. 2;

FIG. 7 is a cross-section along section line B—B of FIG. 2;

FIG. 8 is a cross-section along section line C—C of FIG. 2; and

FIG. 9 is a cross-section along section line D—D of FIG. 2.

Figure 1:
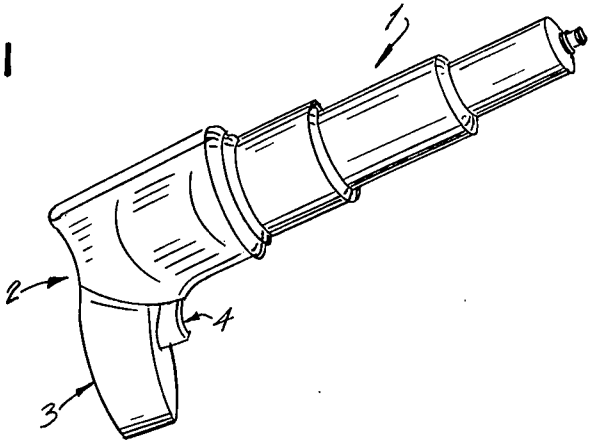
FIG. 1 is a diagrammatic perspective view of the tool with attached electric drive motor.

Referring first to FIG. 1, the tool 1 is shown attached to an electrically driven drive motor unit 2. The motor 2 in this preferred embodiment is the drive unit of a half-inch portable electric drill with hand grip 3 and trigger switch 4. Part of this motor is shown in ghost in FIGS. 2 through 5. It will be appreciated that any drive means providing a suitable rotary output of sufficient power may be utilized with the tool of the present invention and that electrically driven forms of such motor may be mains powered or battery powered.

With reference to FIGS. 2 through 9 the tool 1 is rigidly attached to a cylindrical boss, surrounding an output drive shaft of the motor 2, by means of an annular clamping ring 5 which carries a plurality of clamping screws 6 equally spaced about and radially extending with respect to longitudinal axis 7 of the tool. Disposed around the clamping ring 5 is a cover sleeve 8 which is retained in fixed relationship with the clamping ring 5 by means of one of the screws 6.

The clamping ring defines two diametrically opposed slots 9 in which are housed radially extending keys 10. The outward radial extension of the keys 10 engage longitudinally extending slots 11 formed in one end 12 of an annular clutch housing 13. The one end 12 is slidably received between the sleeve 8 and the clamping ring 5 with the cooperation of the keys 10 and the slots 11 permitting limited longitudinal movement of the clutch housing 13 while restraining rotation of that clutch housing relative to the clamping ring and sleeve assembly. A main tool housing 14 is attached to the clutch housing 12 by a screw attachment 15. The housing is constructed in two parts 16 and 17 connected together by a screw attachment 18 to form a stepped cylindrical member the outer diameter of part 16 of which equals the outer diameter of the one end 12 of the clutch housing for longitudinal sliding motion therewith within the sleeve 8.

Figure 2:
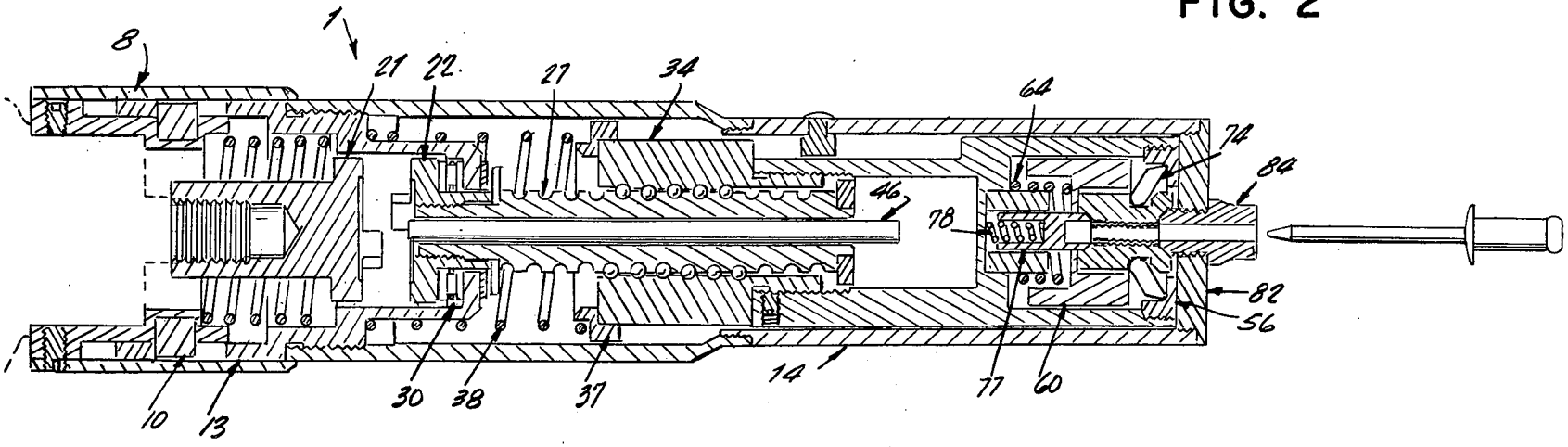
FIGS. 2A and 2B show a sectional side elevation of the tool in a neutral condition ready fcr use.
Figure 2A:
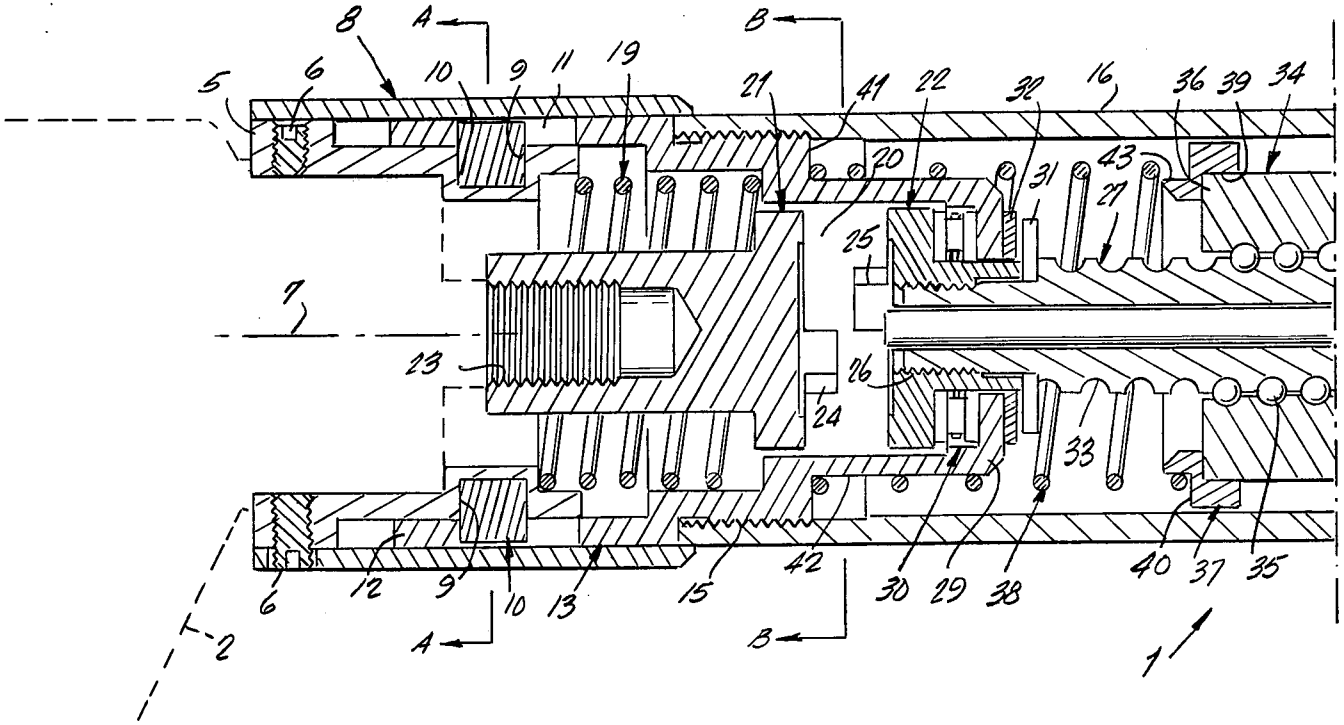
Figure 2B:
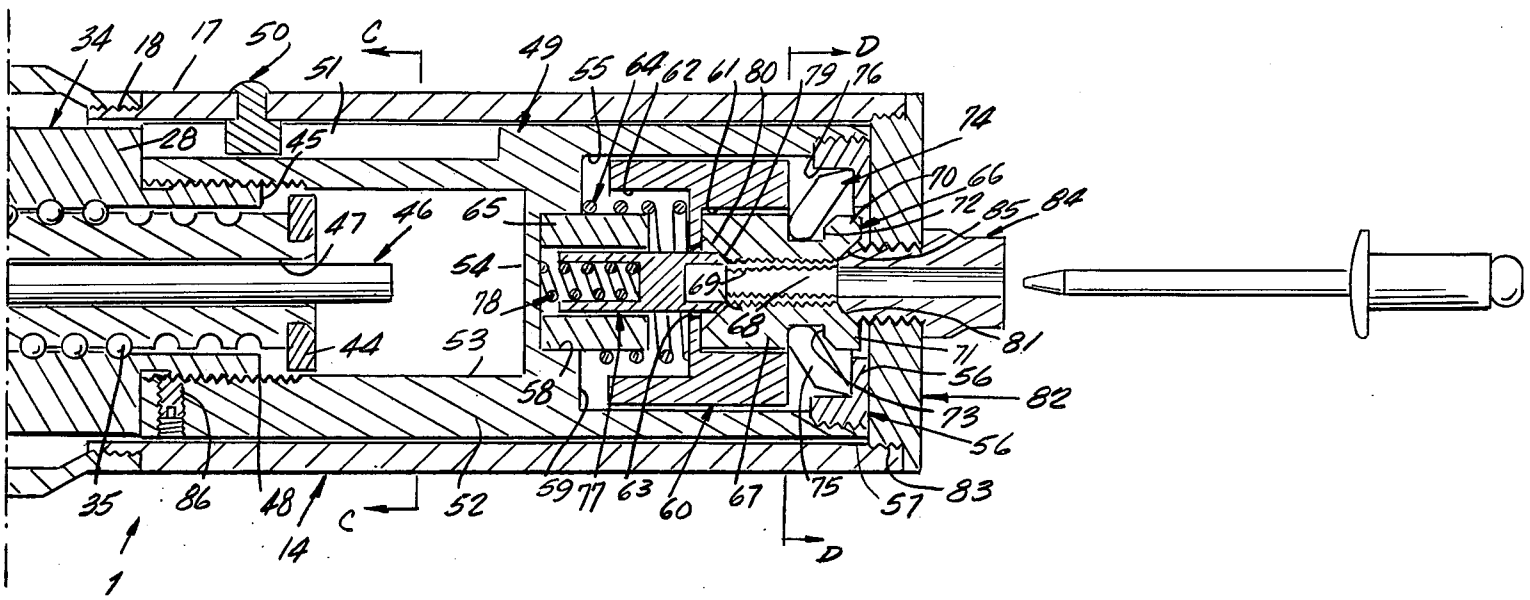

A coil spring 19 having a longitudinal axis co-incident with the longitudinal axis 7 is held under compresion between an annular face of the clamping ring 5 and an annular face of the clutch housing 13 thereby to bias the clutch housing 13 to the position shown in FIG. 2 relative to the clamping ring 5 as constrained by the keys 10. The coil spring 19 is radially located by cylindrical recesses in the clamping ring 5 and clutch housing 13.

The clutch housing 13 houses a dog clutch 20 comprising a driving member 21 and a driven member 22. The driving member 21 is attached to the output shaft of the motor 2 by a screw attachment 23. Extending logitudinally from the end of the driven member 21 remote from the screw attachment 23 are three dog teeth 24. These teeth 24 are equi-angularly disposed about the axis 7 and are shaped to engage, during operation of the tool, corresponding longitudinally extending dog teeth 25 of the driven member 22. The driven member 22 is attached by screw attachment 26 to one end of shaft 27 of a recirculating ball screw and nut 28. The driven member is housed within the clutch housing 13 between the driving member 21 and an end wall 29 of the end of the clutch housing 13 remote from the one end 12. The end wall 29 has a central opening through which a boss of the driven member 22 and the screw attachment end of the shaft 27 extend. The driven member is longitudinally located with respect to the clutch housing 13 by a thrust bearing assembly disposed between an annular end face of the driven member 22 and an annular face of the end wall 29 within the clutch housing 13 and a stop washer 31 clamped between the outer end of the boss of the driven member 22 and the shaft 27 outside of the clutch housing 13. Between the stop washer 31 and the outer end face of the end wall 29 is a thrust washer 32 which is free to rotate but located by the outer periphery of the boss of the driven member 22. The boss of the driven member 22 is restrained to rotation about axis 7 by its location within the opening in the center of end wall 29.

The recirculating ball screw and nut 28 is of conventional design (known in the prior art) with the shaft 27 having a helical groove 33 of semi-circular cross-section formed in its periphery and a nut 34 having formed in its bore a helical groove complimentary to that of the shaft. The ends of the groove in the nut are connected to one another by a passage of sufficient dimension to permit the passage therethrough of balls 35 which are housed in the complimentary grooves within the inner periphery of the nut 34 to provide the rolling low friction motion of the nut along the shaft 27 upon rotation of the shaft relative to the nut.

At the clutch end 36 of the nut an annular spring retainer 37 serves to transmit the axially directed force of return spring 38 to the nut 34. The retainer includes an annular recess 39 within which the clutch end 36 of the nut is located and the return spring 38 is a coil spring held in compresion between an end face 40 of the spring retainer 37 and an oppositely facing end face 41 of the clutch housing 13. The return spring 36 is constrained to have its longitudinal axis located co-axially with axis 7 by the outer periphery 42 of the end of the clutch housing 13 remote from the one end 12 and by the outer periphery of a boss 43 extending outwardly from end face 40 of the spring retainer 37.

An end stop washer 44 is fixedly attached to the end of the shaft 27 remote from the screw attachment 26. The diameter of this stop washer is sufficient to engage the end 45 of the nut remote from the clutch end 36 thereby to prevent removal of the nut from the shaft at this end. A clutch trip rod 46 extends in a freely slidable manner through a bore 47 extending longitudinally through the shaft 27 along the axis 7. The clutch trip rod 46 is of sufficient length to extend completely through the bore 47 to engage the dog teeth carrying end of the driving member 21 while the clutch is disengaged as shown in FIG. 2.

The end 45 of the nut 34 is attached by a screw attachment 48 to a jaw carrier 49. The jaw carrier 49 is of a generally cylindrical form and is located in position by the interior of part 17 of the housing 14. While the cooperation between the housing and the jaw carrier permits sliding relative motion therebetween, rotation of the jaw carrier with respect to the housing is restrained by a key 50 which is rigidly attached to the housing and which extends into a keyway formed in and longitudinally extending along the outer periphery of the jaw carrier whereby the key and the keyway cooperate to permit longitudinal motion of the jaw carrier relative to the housing while preventing relative rotation of these.

The nut end 52 of the jaw carrier 49 defines a longitudinally extending recess 53 to house the end stop washer 44 carrying end of the shaft 27 as the nut 34 moves along this shaft upon rotation thereof. The inner end 54 of recess 53 is located to contact the trip rod 46 to disengage the clutch 20 upon a predetermined travel of the nut 34 along the shaft 27 against the bias of the return spring 38.

The jaw carrier 49 defines a split clamp jaw assembly housing recess 55. This recess extends coaxially with axis 7 inwardly from the end of the jaw carrier remote from the ball screw and nut 28 and is partially closed by an end closure 56 which is attached to the jaw carrier 49 at the entrance to the recess 55 by a screw attachment 57. The recess 55 is of cylindrical form with its longitudinal axis co-axial with axis 7 and the axis of a smaller cylindrical recess 58 extending from the inner end 59 of recess 55 toward recess 53.

Slidably located within recess 55 is a jaw holder 60 which defines, co-axially with axis 7, a jaw housing recess 61 and a reset spring housing recess 62. Recesses 61 and 62 are joined together by opening 63 located on axis 7. A coil reset spring 64, with its longitudinal axis co-axial with axis 7, extends from the inner end face of recess 62 to the inner end 59 of recess 55. This reset spring 64 is maintained in its location by a spring carrier 65 which fits closely within the cylindrical surface of recess 58 and which extends from recess 58 through the inner periphery of a portion of reset spring 64. A pair of jaw members 66 and 67 are housed in the jaw housing recess 61 with their inner ends in contact with the inner end of that recess. The jaw members together define a mandrel gripping opening 68 having a plurality of teeth 69 to provide a non-slipping grip of a mandrel to be gripped by the jaw assembly.

The jaw 66 and 67 have outer ends 70 and 71 projecting from the jaw housing recess 61 and carrying opposed grooves 72 and 73 in which are housed, respectively the radially inner ends of lever members 74 and 75. These lever members 74 and 75 are disposed in an interference fit between the grooves 72 and 73 and the inside of a recess 76 defined by the end closure 56 with the inner ends of the lever members closer axially to the reset spring 64 than are the outer ends of these members. By virtue of this positioning of the lever members 74 and 75, the spring pressure applied to the jaw holder 60 by the reset spring, 64 as transmitted to the jaw members 66 and 67 by the inner end of the jaw housing recess 61, will tend to pivot the lever members 74 and 75 about their contact with the inside of the recess 76, thereby to close the jaw members 66 and 67 together to apply a gripping pressure to a mandrel extending through the mandrel gripping opening 68. The end closure defines an opening co-axial with axis 7 through which the outer ends 70 and 71 of the jaw members may pass.

Within a central longitudinally extending bore of spring carrier 65 is slidably located an ejector pin 77 which extends along axis 7 under the influence of an ejector spring 78 through the opening 63 into contact with the inner ends of jaw members 66 and 67. The ejector pin defines a recess to house the ejector spring 78 and a further recess adjacent the jaw members to accept an end of a mandrel when this is insert into the tool between the jaw members. The end of the ejector pin 77 adjacent the jaw members 66 and 67 has a frusto-conical surface 79 arranged under the spring bias provided by the ejector spring 78 to cooperate with a frusto-conical recess 80 defined by the jaw members 66 and 67. The bias applied to the ejector pin 77 by the ejector spring 78 causes the cooperation of the frusto-conical surface 79 with the frusto-conical recess 80 to tend to force the jaw members 66 and 67 apart. The outer ends 70 and 71 of the jaw members 66 and 67 together define a frusto-conical recess 81 oppositely oriented but similar to the recess 80.

The end of the part 17 of the housing remote from part 16 is closed by an end cap 82. The end cap 82 is attached by a screw attachment 83 to the part 17 and defines a threaded central opening into which is screwed a rivet and mandrel guide 84. The mandrel guide has a central passage co-axial with axis 7 which is of a diameter to guide the mandrel of a "blind rivet" between the jaw members 66 and 67 when the mandrel is inserted in the tool. The inner end of the guide 84 carries a frusto-conical surface 85 which is arranged to cooperate with the frusto-conical recess 81 to tend to move the jaw members 66 and 67 apart.

The end cap 82 together with the housing 14 and the clutch housing 13 provide a rigid structure within which the return spring 38 urges the nut 34 and jaw carrier 49 assembly into contact with the inside of the end cap 82. With the tool in the position shown in FIG. 2 the pressure exerted by the end spring 38 urges the frusto-conical recess 81 into contact with the frusto-conical surface 85 with sufficient pressure to urge the jaw members 66 and 67 apart. To achieve this movement the jaw members are moved longitudinally against the bias of the recess spring 64. At the same time the frusto-conical surface 79 of the ejector pin 77 cooperates with the frusto-conical recess 80 to urge, under the influence of the ejector spring 78, the inner ends of the jaw members 66 and 67 apart. The combined effect of the frusto-conical surfaces and recesses is to hold the jaw members 66 and 67 apart in a parallel relationship permitting free entry of a mandrel between the jaw members.

The jaw members 66 and 67 are orientated relative to one another by jaw guides (not shown) housed in diametrically opposite slots (not shown) in the jaw holder 60.

The direction of rotation of the output of the motor 2 and the handedness of the various thread attachements and the ball screw and nut are chosen such that upon operation of motor 2, with the clutch 20 engaged, the nut 34 will move longitudinally closer to the clutch housing 13.

Although operation of the tool of this invention will be described with specific reference to a "blind rivet" it will be appreciated that the tool is suitable for use in any situation in which it is desired to longitudinally move a mandrel with respect to an associated member, for example, a fastner such as that described in U.S. Pat. No. 3,796,124.

When it is desired to operate the tool of the present invention to apply a "blind rivet" the operation is commenced with a tool in the condition shown in FIG. 2. The mandrel of the "blind rivet" is inserted through the bore of the guide 84 between the jaw members 66 and 67 to the mandrel receiving recess in the ejector pin 77. Further insertion of the mandrel will move the ejector pin 77 away from the frusto-conical recess 80 thereby permitting the inner ends of the jaw members 66 and 67 to move inwardly under the combined influence of the reset spring 64 and the lever members 74 and 75 to engage the periphery of the mandrel. This movement of the jaw members 66 and 67 results in them moving slightly over the frusto-conical surface 85 of the guide 84 to adopt the position shown in FIG. 3. The condition of the tool shown in FIG. 3 also includes, with respect to FIG. 2, the movement of the housing 14 and clutch housing 13 longitudinally along axis 7 toward the motor 2 within the confines of the movement permitted by the key 10 and slot 11 combination to engage the teeth 25 of the driven member with the teeth 24 of the driving member. This movement is achieved either manually by the operator pulling the housing back with respect to the motor 2 or by the application of pressure upon the motor and sleeve combination to push the outer end of the guide 84 against the "blind rivet" flange and structure to be riveted. This longitudinal movement is opposed by spring 19 which is compressed to bias the clamping ring 5 and clutch housing 13 into the position shown in FIG. 2.

Figure 3:
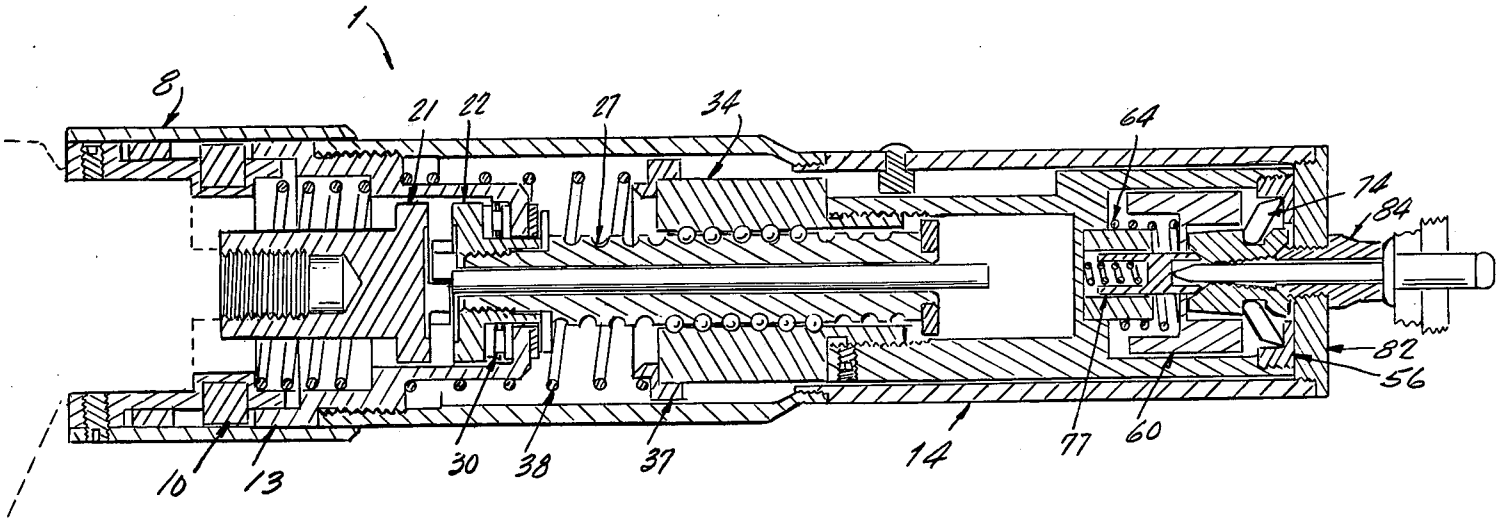
FIG. 3 is the elevation shown in FIG. 2 with a "blind rivet" mandrel inserted.
Figure 4:
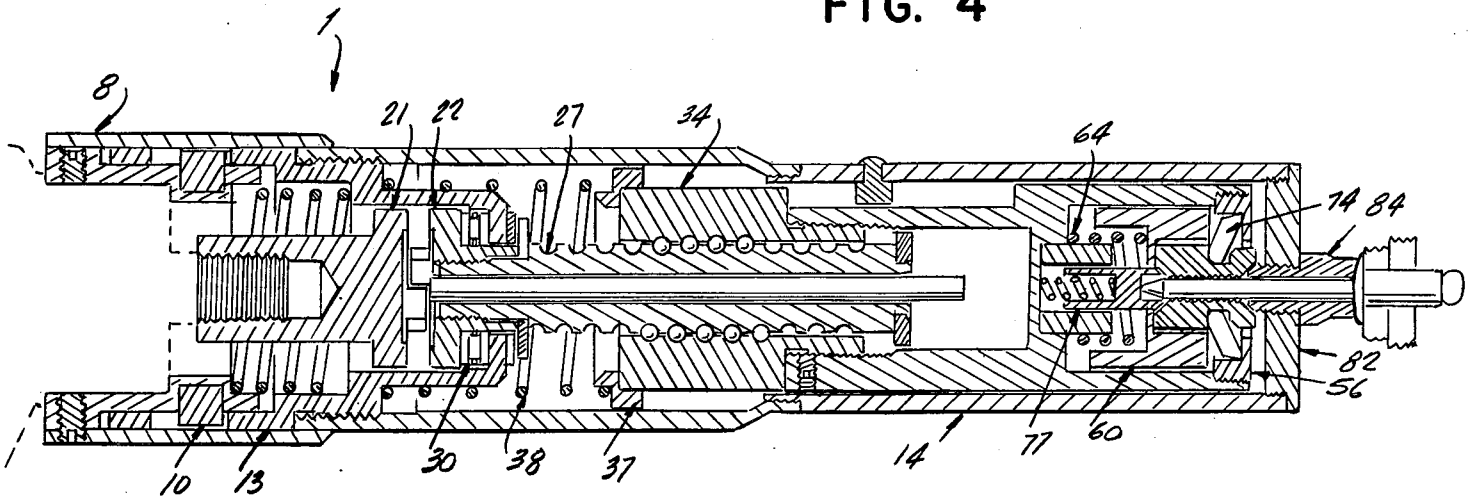
FIG. 4 is the elevation shown in FIG. 2 with the "blind rivet" mandrel fully engaged at the beginning of operation.

When the tool is in the condition shown in FIG. 3 the motor 2 is operated to rotate the driving member 21 and consequently, by way of the engaged teeth 24 and 25 and the driven member 22, to rotate the shaft 27. Rotation of the shaft 27 draws the nut 34 along the shaft by, virtue of the operation of the recirculating balls, against the pressure exerted by the return spring 38. The nut is restrained from rotation by the key and keyway arrangement of the jaw carrier 49. In order to ensure that the screw attachment 48 remains tight a clamping screw 86 extending radially through the jaw carrier 49, is clamped against the threads forming the nut's portion of the screw attachment 48. As the shaft 27 commences to draw the nut 34 along the shaft the jaw carrier 49 is moved away from the end cap 82 carrying with it the jaw assembly including the jaw members 66 and 67. This movement disengages the frusto-conical recess 81 from the frusto-conical surface 85 of the guide 84 with the consequence that the jaw members 66 and 67, under the influence of the reset spring 64 and the lever members 74 and 75 move toward one another to engage the periphery of the mandrel along the entire length of the mandrel gripping opening 68 (see FIG. 4).

Continued movement of the nut 34 along the shaft 27 causes the lever members 74 and 75 to exert mandrel gripping pressure on the jaw members 66 and 67 sufficient to insure that the teeth 69 grip the mandrel in a slippage free manner. The continued movement of the nut 34 draws the mandrel through the guide 84 thereby forming the fastened "blind rivet" and this movement continues until the tensile stress applied to the mandrel is sufficient to break the mandrel off at the desired spot in the fastened "blind rivet". During this movement of the nut the end face 54 moves the trip rod 46 to drive this trip rod through the bore 47 in the shaft 27 until it contacts the driven member 21. At the point of mandrel breakage in the operation of the tool, the clutch 24 is still engaged and the shaft 27 is still rotating to draw the nut therealong. Further movement of the nut 34, by virtue of the presence of the trip rod between the end face 54 and the driving member 21, causes the clutch housing 13 to be drawn away from the motor 2, by virtue of the longitudinal movement permitted by the key 10 and slot 11 arrangement, until the teeth 24 of the driving member 21 and the teeth 25 of the driven member 22 are disengaged from one another. This movement of the clutch housing 13 results from the inability of the nut 34, as a result of the presence of the trip rod 46, to move any closer to the driving member 21. In this situation continued rotation of the shaft 27 is only possible by virtue of the ability of the shaft itself to move longitudinally through the nut to the extent permitted by the key 10 and slot 11 arrangement. This longitudinal movement of the clutch housing 13 is achieved by the transmission of the now necessary longitudinal movement of the shaft 27 through the driven member 22, and the thrust bearing 30 to the clutch housing 13.

Figure 5:
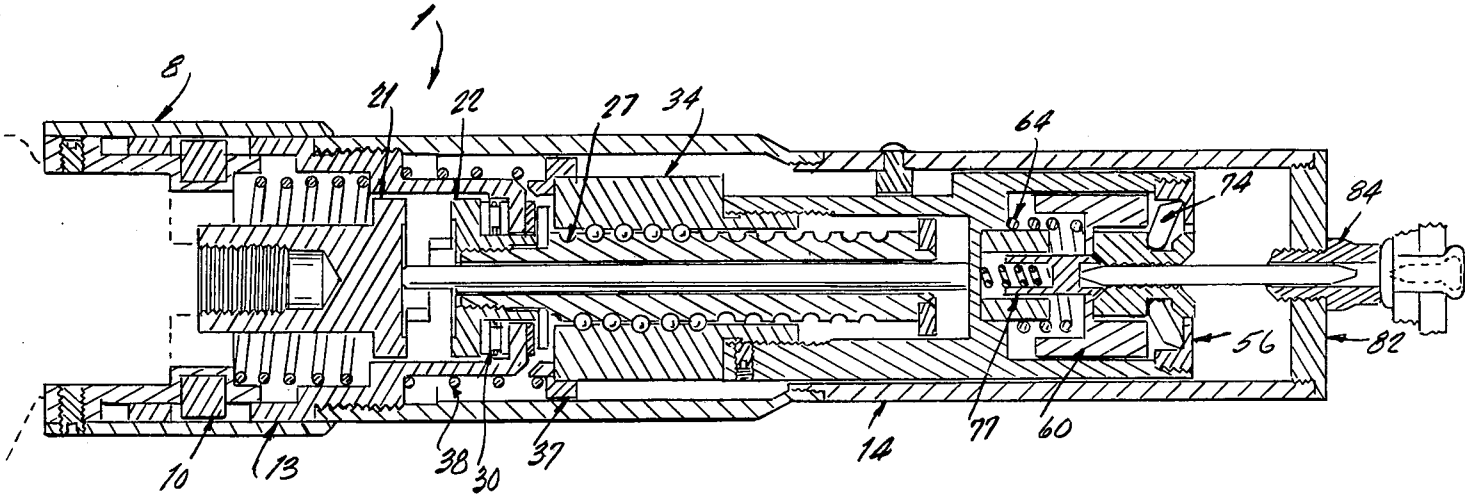
FIG. 5 is the elevation of FIG. 2 following breaking of the mandrel from the "blind rivet" and disengagement of the tool drive prior to ejection of the mandrel and return of the tool to the condition shown in FIG. 2.

Upon disengagement of the teeth 25 from the teeth 24 rotation of the shaft 27 ceases and the tool is in the condition shown in FIG. 5. The tool is then moved away from the fastened "blind rivet" and the return spring exerts sufficient pressure on the nut 34 by way of the spring retainer 37 to overcome the friction of the recirculating balls of the screw and nut 28 so that the longitudinal pressure on the nut 34 will rotate the shaft 27 to permit movement of the nut toward the position shown in FIG. 2. With the return of the nut 34 to the position shown in FIG. 2 the jaw carrier 49 moves into contact with the end cap 82 and the frusto-conical recess 81 of the jaw members 66 and 67 moves into contact with the frusto-conical surface 85 of the guide 84. The pressure exerted by the return spring 38 forces the jaw members 66 and 67 inwardly to overcome the reset spring 64 so as to release the gripped mandrel. This release of the mandrel permits the ejector spring 78, by way of the ejector pin 77 to eject the mandrel from the tool. This ejection is assisted by the initial movement of the ejector pin 77 serving to bring the frusto-conical surface 79 into engagement with the frusto-conical recess 80 to move the jaw members 66 and 67 apart into the position in which they are shown in FIG. 2.

The strength of the ejector spring 78 is chosen to be sufficient only just to eject a mandrel from the tool when the tool is held horizontally. This limitation is provided to insure that the dangerous ejection of mandrels is avoided.

With the movement of the nut to the position shown in FIG. 2 the trip rod 46 is released and the clutch 24 is free to be brought into engaged condition upon the insertion of the mandrel of a further "blind rivet" into the guide 84 together with the movement of the housing 14 and clutch housing 13 longitudinally with respect to the motor 2 against the bias provided by the spring 19.

At any time after disengagement of the clutch 24 by virtue of movement of the trip rod 46 the drive provided by the motor 2 may be discontinued to be restarted following engagement of the clutch in the next operating cycle.

It will be appreciated that many variations of the above particularly described tool will be apparent to an average man skilled in the art without departing from the inventive concept of the present invention. The following claims are to be construed as including such variations.

I claim:

1. A tool for releasably gripping a rod comprising:

a support structure;

a rod clamping assembly connected to said structure and movable relative to said structure;

a release means connected to said structure and adapted to cooperate with said clamping assembly, when said clamping assembly and said structure are at one end of said relative movement, to release a said rod gripped by said clamping assembly; and means for producing said relative movement;

wherein, upon operation of said means to produce said relative motion, away from said one end, a said rod, when gripped by said clamping assembly, is moved longitudinally relative to said structure;

wherein the means for producing said relative movement comprises:

a motion converter having first and second members supported by said structure and adapted to convert rotary motion of said first member into linear motion on said second member and vice versa;

a clutch supported by said structure, having a driving member and a driven member connected to transmit rotary motion to said first member;

means for selectively engaging said clutch;

means to disengage said clutch; and biasing means connected to bias said second member in opposition to the linear motion produced by said rotary motion; and wherein said second member is connected to transmit said linear motion to said clamping assembly to produce said relative motion, away from said one end, in opposition to the bias of said biasing means, when said clutch is engaged by said selective engaging means to transmit a rotary input motion to said first member;

said clutch disengaging means cooperates with said clutch to contact and disengage said clutch when said relative motion has produced a predetermined travel of said clamping assembly away from said one end;

said biasing means being connected to return said second member and said clamping assembly to said one end of said relative motion upon disengagement of said clutch.

2. A tool according to claim 1 wherein said clamping assembly comprises:

a housing having an opening permitting projection of a said rod into said housing;

a split clamp means captively disposed in said housing and defining a rod engaging opening; and a resilient means to bias said split clamp means into engagement with a said rod projecting through said rod engaging opening; whereby said split clamp means is in an interference fit between said housing and said rod and said rod is gripped by said clamping assembly.

3. A tool according to claim 1 wherein said tool defines a longitudinal axis about which said first member, said driving member and said driven member rotate and along which said relative motion takes place;

wherein said driven member and said first member are rigidly attached together;

a bore extends along said axis through said first member and said driven member;

said clutch disengaging means is an elongate rod slidably supported in said bore to cooperate with said clamping assembly and said driving member and to disengage said clutch upon the occurance of said predetermined travel of said clamping assembly.

4. A tool according to claim 3 wherein said structure and a clutch support housing together define a housing assembly;

said clutch support housing is rigidly attached to said housing;

said driven member is supported for rotation about said axis by said clutch housing and is restrained from longitudinal motion along said axis by said clutch housing;

said housing assembly is longitudinally movable relative to said driving member to selectively engage said clutch; and said clutch disengaging rod is longitudinally moved by said clamping assembly to produce relative motion between said housing assembly and said driving member to disengage said clutch upon occurance of said predetermined travel.

5. A tool according to claim 4 wherein said biasing means is a coil spring disposed in compression between said clutch housing and said second member and said relative motion between said housing assembly and said driving means is opposed by a clutch spring.

6. A tool according to claim 5 comprising a clamping ring adapted for the attachment of said tool to a means for rotating said driving means and a key supported by said clamping ring, wherein said housing assembly defines a slot which cooperates with said key to prevent rotation of said housing assembly relative to said clamping ring while permitting longitudinal motion of said housing assembly, relative to said clamping ring and said driving means, sufficient for the selective engagement of said clutch.

7. A tool according to claim 1 wherein said motion converter is a recirculating ball screw and nut device said screw being said first member and said nut being said second member;

said clamping assembly is rigidly attached to said nut;

said driven member is rigidly attached to said screw and said clutch is a dog clutch in which said driving and driven members have opposed symetrically arranged longitudinally extending teeth arranged for engagement with one another, when said cutch is engaged, to transmit rotary motion from said driving means to said driven means.

8. A tool according to claim 7, wherein said clamping assembly includes a longitudinally extending keyway with which a key fixedly attached to said structure cooperates to prevent rotation of said clamping assembly, and said nut rigidly attached thereto, while permitting said relative motion of said clamping assembly longitudinally with respect to said structure.

* * * * *